United States Patent [19]

Beck et al.

[11] 4,251,207

[45] Feb. 17, 1981

[54] PROCESS AND APPARATUS FOR PREHEATING COKING COAL

[75] Inventors: Kurt-Günther Beck, Essen-Bredeney; Georg Pollert, Essen; Wolfgang Rohde, Essen-Heisingen, all of Fed. Rep. of Germany

[73] Assignee: Bergwerksverband GmbH, Essen, Fed. Rep. of Germany

[21] Appl. No.: 14,977

[22] Filed: Feb. 26, 1979

[30] Foreign Application Priority Data

Feb. 24, 1978 [DE] Fed. Rep. of Germany ..... 2807946

[51] Int. Cl.[3] ..... F26B 3/08

[52] U.S. Cl. ..... 432/14; 201/41; 202/262; 34/57 A

[58] Field of Search ..... 432/14–16, 432/18, 58, 190, 191, 72; 34/10.57 A, 57 B; 201/41; 202/262

[56] References Cited

U.S. PATENT DOCUMENTS

| | | | |
|---|---|---|---|
| 2,763,478 | 9/1956 | Parry | 432/15 |
| 3,732,062 | 5/1973 | Porteus | 432/16 |
| 3,787,171 | 1/1974 | Cromp | 432/72 |
| 4,101,264 | 7/1978 | Barr | 432/14 |
| 4,102,635 | 7/1978 | Beck | 34/10 |
| 4,139,419 | 2/1979 | Limberg | 201/41 |

*Primary Examiner*—Henry C. Yuen
*Attorney, Agent, or Firm*—Michael J. Striker

[57] ABSTRACT

Coking coal is preheated and dried by passing hot carrier gas into a generally vertical flash drying pipe, then passing comminuted coal into the same pipe, the carrier gas being blown with a flow speed to move the coal upwards in the pipe and passing at about the midpoint of the pipe a mixture of hot combustion gases and additional hot recycle gas branched off from the other hot waste gas line into the pipe so as to cause further heating and moving of the coal, the further heating being carried out in a uniform and gentle manner. At the end of the pipe the coal and carrier gas are separated and the coal is recovered while the waste gas are recycled into a blower and therefrom into the vertical flash drying pipe with a branch leading part of the recycle gas into a mixing chamber with the combustion gases so as to lower the temperature of the combustion gases when the same are passed into the pipe.

5 Claims, 1 Drawing Figure

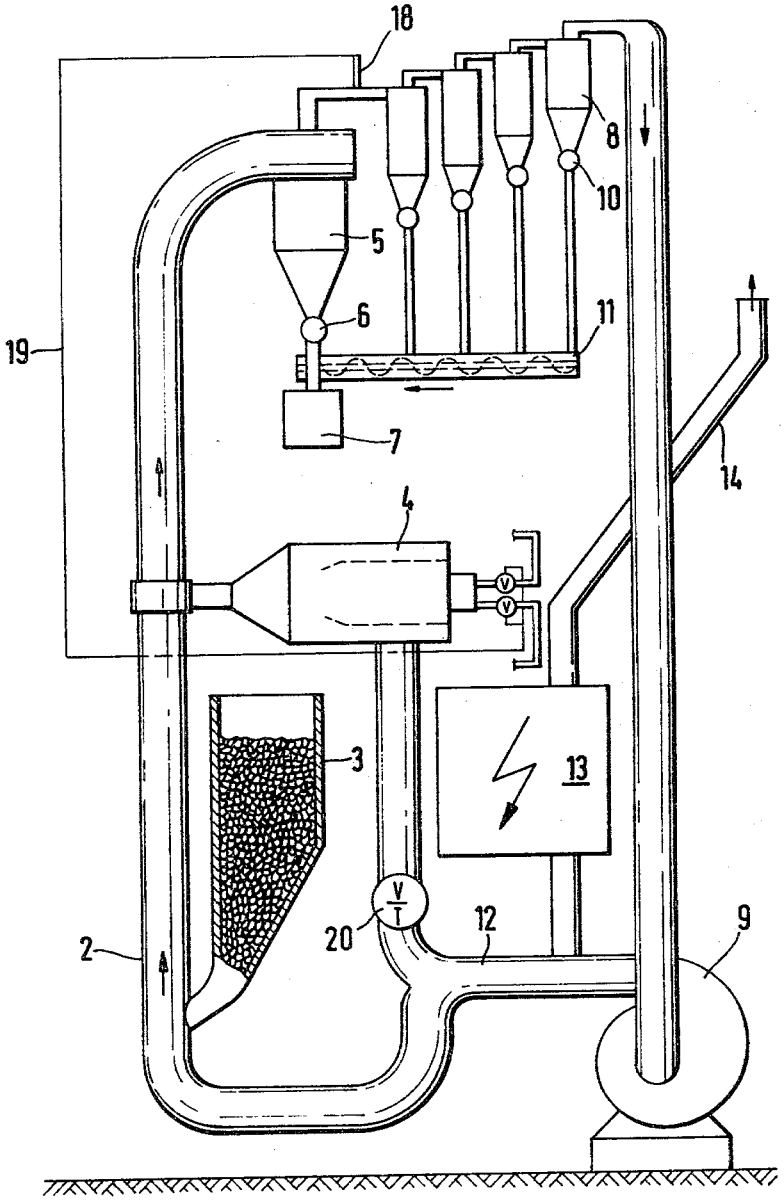
18
8
10
5
6
11
19
7
14
4
3
13
20
12
9
2

PROCESS AND APPARATUS FOR PREHEATING COKING COAL

BACKGROUND OF THE INVENTION

This invention relates to a process and apparatus for preheating coking coal. The invention involves an improvement over the invention of U.S. Pat. No. 4,102,635 issued Apr. 24, 1978.

The drying and preheating of coking coal is usually effected in an one-stage or two-stage flash drying system. For drying the coal, for instance by heating to a temperature of about 90° C. a one-stage flash dryer is usually sufficient. For a heating to higher temperatures, for instance to about 250° C. a two-stage pipe system is usually used in which in a first stage the drying of the coal is effected to a residual moisture contents of 1 to 2% at a temperature of about 85° to 90° C. The released water vapor in this stage is withdrawn from the pipe system. The subsequent further heating of the mass is effected in a second series connected pipe.

A one-stage single flash drying pipe has also been used in which the recycled moist gases in mixture with hot combustion gases lift the coal which is introduced at the lower end of the flash drying pipe upwards in the pipe. The wast gases leaving the flash drying pipe at the upper end, however, have only a temperature between about 100° and 150° C. (German accepted application No. 1,160,823).

Two-stage flash drying systems are usually operated with two separate pipes which operate in countercurrent insofar as the heat conduct is concerned while a cocurrent exists in the pipe itself. In this case, also, the vapors discharged from the first stage have only a temperature between about 100° and 150° C.

The attempt has also been made to effect the entire preheating of the coking coal to a temperature of about 250° C. in a single flash drying pipe system. In this case, however, in order to reach the desired temperature the entry temperature of the carrier gas had been very high so that through the spontaneous water evaporation from the moist coking coal a large part of the granular mass burst and in which also alteration of the product occurred which resulted in highly undesirable effects on the coking quality of coal.

In the earlier U.S. Pat. No. 4,102,635 these shortcomings were avoided by preheating the coking coal to temperatures between about 180° and 250° C., preferably to about 150° to 180° C. in a single flash drying. In this pipe after preheating the coal in the lower area of the pipe to about 80° to 100° C. a hot combustion gas was introduced at about the midpoint of the flue which gas was at a temperature between 1200° to 1700° C., preferably between about 1400° and 1600° C. Thus, the coal in the second stage was heated to about 120° to 250° C., preferably to 150° to 180° C. This accordingly was a two-stage single pipe flash drying pipe which was operated in cocurrent. A bursting and oxidation of the coal in this process was avoided.

The present invention has the object of improving on the process of the just-described patented invention.

SUMMARY OF THE INVENTION

The inventors have surprisingly found that a preheating of the coal can be effected in a more uniform and gentle manner by adding to the hot combustion gases having temperatures between 1200° and 1700° C. which are introduced at about the midpoint of the pipe such additional recycled wast gas (recycle gas) that the temperature of the mixture of hot combustion gases and recycle gas when entering the pipe at about midpoint was between about 600° and 1200° C., preferably between 800° and 1100° C.

Depending on the temperature and amount of the mixture of hot combustion gases and recyle gas vapors which are introduced at about midpoint of the pipe, the temperature of the exiting gas at the upper end of the pipe is at about 300° to 500° C. The temperature and still more importantly, the amount of the gas mixture of hot combustion gases and recycle gas must accordingly be adjusted to the desired temperature of the gas to be recycled. Usually, the temperature of the recycle gas should be between about 200° and 400° C.

The introduction of a mixture of hot combustion gases and recyle gas at about midpoint of the flash drying pipe into the already partly predried coal results in an increase of the carrier gas volume. It is, however, necessary to provide for about the same flow conditions in the upper half of the flash drying pipe as exists in the lower half in spite of the introduction of the mixture of combustion gases and recyle gas at midpoint of the pipe and the resulting increase in the volume of carrier gas. For this reason it is preferably to increase the cross section of the pipe starting upwardly from the midpoint.

The recycle gas are thus passed into the flash drying pipe both at the lower end and at the midpoint. At the latter point they are mixed with the combustion gases. Any excess of moist gas can be discharged in conventional manner into the atmosphere. As already pointed out in U.S. Pat. No. 4,102,635 if necessary additional combustion gas may either be obtained from the combustion chamber provided at about the center of the height of the flash drying pipe or from a separate combustion chamber at the lower end of the flash drying pipe.

The process for preheating of the coking coal according to the invention accordingly provides for a second preheating stage which has its own gas circuit. This will result, as already pointed out, in an increase of the volume of gas in the second stage. The entry temperature of the mixture of combustion gases and recycle-gases at the midpoint of the flash drying pipe should be between about 600° and 1200° C., preferably between 800° and 1100° C.

The advantage of this improvement is a more gentle and more uniform treatment of the preheated coking coal.

It will be understood that the process of the present improvement shares also in all the advantages already pointed out in the referred-to issued patent. Also, the process as such is the same as in the patent with the important difference that the branch is provided in the duct of the recycle gas which may also include a valve device. This branch serves to pass part of the recycle gas into mixture with the combustion gases and then introduce such mixture at midpoint into the flash drying pipe.

DESCRIPTION OF THE PREFERRED EMBODIMENT

The invention will be further understood by reference to the single drawing. Hot moist gas of a temperature of about 380° C. is passed from the recycling duct 12 into a vertically disposed flash drying pipe. At a short distance from the entry spot of that moist gas moist coal is introduced from a supply bin 3. The so called carrier gas have a sufficient flow speed to convey the moist coal upwards, while at the same time effecting its drying. As soon as the coal has reached about the midpoint of the flash drying pipe its temperature will be about 90° C. while the temperature of the so called carrier gas at that point will be about between 150° and 200° C.

To preheat the coal at its further passage through the flash drying pipe to a still higher temperature, for instance to about 200° C., it is necessary to increase the gas temperature to about 550° C. This is effected by arranging at the midpoint of the pipe a combustion chamber 4 in which combustion gases of a temperature of about 1530° C. are generated. These combustion gases are cooled down by the additional recycle gas passed through the branch of the duct 12 and regulated in their amount by a valve 20. The mixture of gases is thus cooled to about 830° C. when entering the flash drying pipe. This results in an increase of the carrier gas temperature in the flash drying pipe to about 550° C. The coal is then heated in the remaining part of the flash drying pipe prior to entering the cyclone 5 to the desired temperature of about 200° C.

If desired, it is also possible to add hot combustion gases from the combustion chamber 4 by a duct (not shown) to the carrier gas in order to increase the mixture of gases. Such hot combustion gases can of course also be obtained from another combustion chamber which may, for instance, be arranged at the bottom end of the flash drying pipe.

The major part of the coal is then separated in the main cyclone 5 and is passed via a rotary valve 6 to the conveyor 7 which is in the form of a chain conveyor and provides for the further movement of the coal at the place where it is subjected to further processing.

The waste gas discharged from the main cyclone 5 may then be further purged in the cyclones 8 before being recycled at a temperature of about 300° to 400° C. into the blower 9. The blower 9 provides the flow speed necessary for moving the coal upwards in the pipe 2.

The coal fines which are separated in the cyclones are likewise passed via rotary valve to a chain conveyor 11 which provides for moving the dust to the conveyor 7.

At the pressure side of the blower 9 part of the wast gas is passed from the duct 12 into the lower end of the flash drying pipe while another part is passed through the valve 20 into the mixing chamber of the combustion chamber. Any excess portion of the wast gas is discharged after cleaning by an electrostatic precipitator 13 into the chimney 14.

If desired, the wast gas may also be recycled in nonpurified condition, at least partly after the first separation has been effected in the main cyclone 5. The final purging of the wast gas may be limited to these wast gas which pass into the chimney 14.

The adjustment of the heat contents of the carrier gas in the flash drying pipe between the gas entry at the lower end and the midpoint may be effected by a sensor (not shown) provided at the end of the flash drying pipe. This sensor may be connected for automatic adjustment with the automatic regulation of the combustion chamber 4 or with the valve 20 or with any additional combustion chamber which may be employed at the bottom end of the flash drying pipe.

The temperature of the carrier gas in the flash drying pipe between the intermediate point and the main cyclone 5 at the end point may also be adjusted, for instance by a temperature sensor 18 as indicated in the drawing. This sensor is connected through a line 19 either with the automatic burner regulation of the combustion chamber 4 or with the valve 20. In case of an automatic regulation the valve may be provided with an electrical adjustment device.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of pre-heating coking coal, comprising the steps of entraining the coal in a first gaseous carrier fluid which is at a temperature of about 80°–100° C.; passing the stream of coal and first gaseous carrier fluid through a preheating zone in which the carrier fluid preheats the coal; feeding towards said preheating zone, at a region thereof at which the coal has already been preheated to a predetermined temperature by the carrier fluid, a second gaseous fluid at a temperature of about 1200°–1700° C.; and admixing with said second gaseous fluid prior to entry into said region, a third gaseous fluid which is cooler than said second gaseous fluid, so that the mixture of said second and third gaseous fluids enters said region at a temperature of about 600°–1200° C.

2. A method as defined in claim 1; further comprising the step of separating the coal from the gaseous fluids after traversal of the preheating zone; and wherein the step of admitting comprises recirculating some of the separated gaseous fluids to form said third gaseous fluid.

3. A method as defined in claim 1, wherein the step of passing comprises directing the stream in a generally vertical direction.

4. A method as defined in claim 1, wherein the coal is heated to about 90° C. by said first gaseous fluids and to about 200° C. by said second and third gaseous fluids.

5. A method as defined in claim 1, wherein the mixture of said second and third gaseous fluids enters said region at a temperature of about 800°–1100° C.

* * * * *

UNITED STATES PATENT AND TRADEMARK OFFICE

CERTIFICATE OF CORRECTION

PATENT NO. : 4,251,207

DATED : February 17, 1981

INVENTOR(S) : Kurt-Günther Beck et al

It is certified that error appears in the above-identified patent and that said Letters Patent are hereby corrected as shown below:

On the Title page

In the heading, the name and address of the second assignee should be added, and read -- Didier Engineering GmbH, Essen, Germany --.

Signed and Sealed this

*Twenty-first* Day of *September 1982*

[SEAL]

*Attest:*

GERALD J. MOSSINGHOFF

*Attesting Officer*

*Commissioner of Patents and Trademarks*